US005989655A

United States Patent [19]

Meng

[11] Patent Number: 5,989,655

[45] Date of Patent: Nov. 23, 1999

[54] CRYSTAL BALL ORNAMENT

[76] Inventor: Sally Meng, 8F, No.22, Lane 81, Wen-Hu Rd., Taipei, Taiwan

[21] Appl. No.: 09/055,387

[22] Filed: Apr. 6, 1998

[51] Int. Cl.[6] ..... F21V 7/04

[52] U.S. Cl. ..... 428/13; 362/806; 362/808; 446/267; 40/406

[58] Field of Search ..... 428/13, 119; 362/806, 362/808; 40/406, 410; 446/267

[56] References Cited

U.S. PATENT DOCUMENTS

| | | | |
|---|---|---|---|
| 4,170,035 | 10/1979 | Walker | 362/806 |
| 4,771,902 | 9/1988 | Teng | 40/410 |
| 5,088,218 | 2/1992 | Liu | 40/411 |
| 5,090,144 | 2/1992 | Liu | 40/410 |
| 5,416,995 | 5/1995 | Teng | 40/419 |
| 5,675,921 | 10/1997 | Lin | 40/409 |

*Primary Examiner*—Alexander Thomas
*Attorney, Agent, or Firm*—Ladas & Parry

[57] ABSTRACT

A crystal ball ornament includes a holder base, a light source mounted in the holder base, a transparent ball mounted on the holder base, the transparent ball holding a liquid and ornamental means in the liquid, a porous ornamental plate mounted on the holder base and spaced between the light source and the transparent ball, the ornamental plate having tiny holes showing a pattern, and a reflector mounted in the holder base to reflect light from the light source onto the transparent ball through the tiny holes on the ornamental plate.

6 Claims, 2 Drawing Sheets

CRYSTAL BALL ORNAMENT

BACKGROUND OF THE INVENTION

The present invention relates to a crystal ball ornament, and more particularly to such a crystal ball ornament which uses a liquid in a transparent ball to refract light, that passes from a light source in a holder base through tiny holes on an ornamental plate on the holder base, so as to produce a lighting effect.

A regular crystal ball is a solid sphere that magnifies the image of an object. When light from a light source is projected onto a crystal ball, light rays are refracted in all directions, thereby causing a fantastic lighting effect to be produced. Because this kind of crystal ball is expensive, its decorative value is limited.

SUMMARY OF THE INVENTION

According to one aspect of the present invention, the crystal ball ornament comprises a holder base, a light source mounted in the holder base, a transparent ball mounted on the holder base, a porous ornamental plate mounted on the holder base and spaced between the light source and the transparent ball, the ornamental plate having tiny holes showing a pattern, and a reflector mounted in the holder base to reflect light from the light source onto the transparent ball through the tiny holes on the ornamental plate, causing a lighting effect to be produced. According to another aspect of the present invention, the transparent ball holds a liquid on the inside, and ornamental means in the liquid. According to still another aspect of the present invention, the tiny holes of the ornamental plate form a pattern.

DETAILED DESCRIPTION OF THE PREFERRED EMBODIMENT

Figure 1:
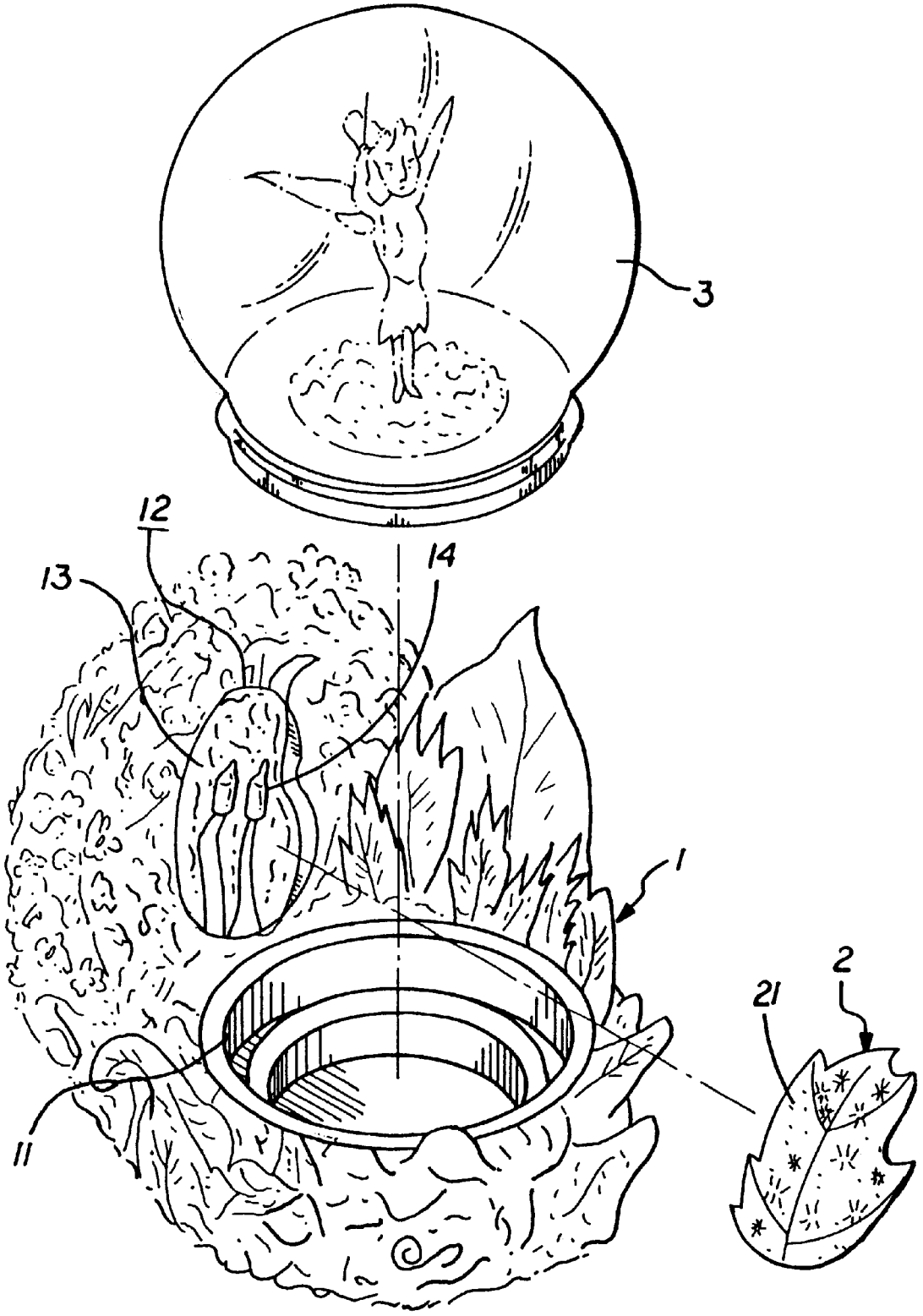
FIG. 1 is an exploded view of a crystal ball ornament according to the present invention.

Referring to FIG. 1, a crystal ball ornament in accordance with the present invention is generally comprised of a substantially L-shaped holder base 1, an ornamental plate 2, and a ball 3.

Figure 2:
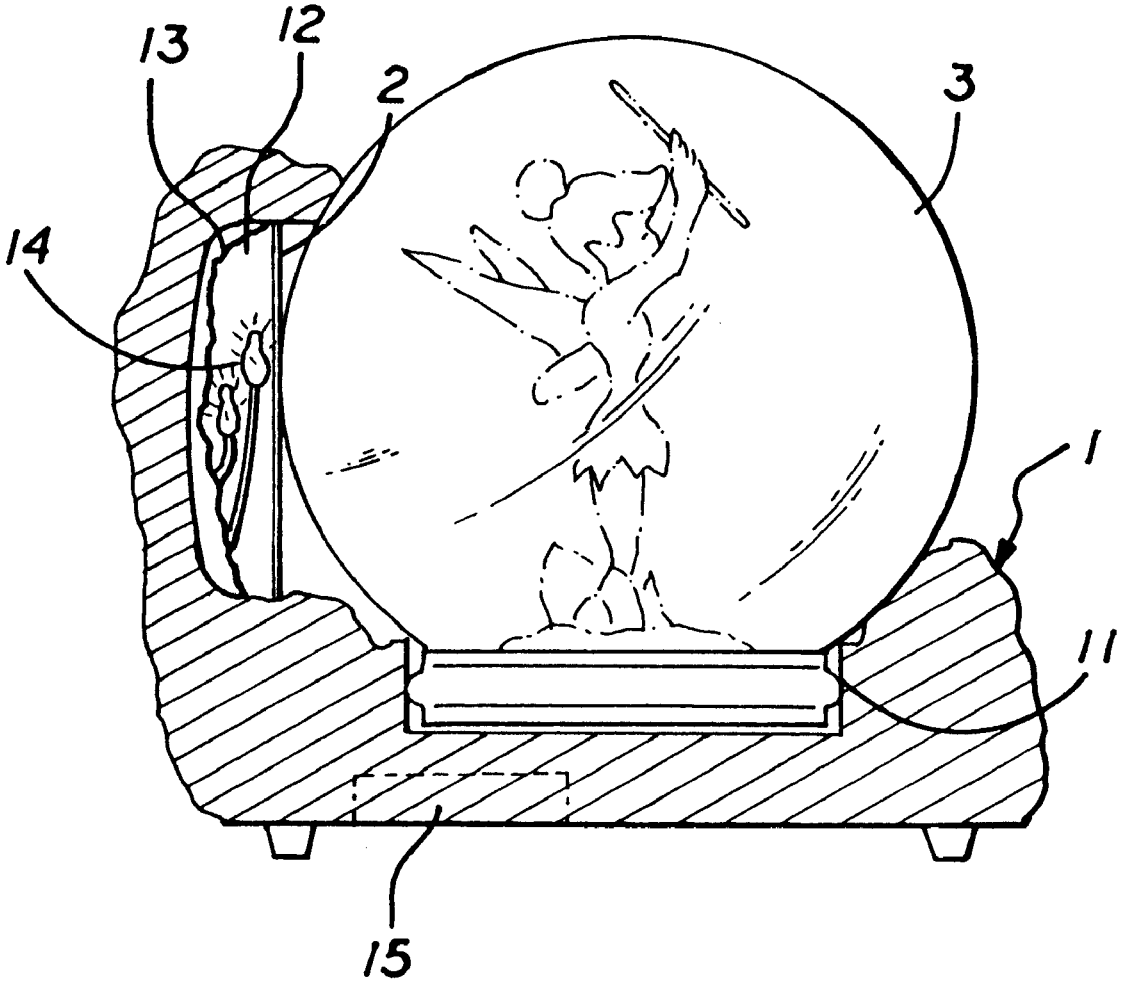
FIG. 2 is a sectional assembly view of the crystal ball ornament shown in FIG. 1.

Referring to FIG. 2 and FIG. 1 again, the holder base 1 comprises a recessed hole 11 at the top of the horizontal wall thereof, an open chamber 12 at the vertical wall thereof, a battery chamber 15 at the bottom of the horizontal wall beneath the recessed hole 11, a reflector 13 provided inside the open chamber 12, and a plurality of light emitting elements for example bulbs 14 respectively mounted in the open chamber 12 in front of the reflector 13. The reflector 13 can be a wrinkled aluminum foil, or a reflecting mirror having a plurality of reflecting facets. The battery chamber 15 holds a battery (not shown) which provides the necessary power supply to the bulbs 14. The ornamental plate 2 is covered on the open chamber 12, having a plurality of tiny holes 21. The ornamental plate 21 can have any of a variety of designs. The tiny holes 2 of the ornamental plate 21 show a particular pattern for example a pentagram. The design of the ornamental plate 2 is formed by chemical etching. The ball 3 is a transparent, spherical, water-tight container holding a liquid and ornamental means in the liquid, and mounted in the recessed hole 11 on the holder base 1 in front of the ornamental plate 2.

Referring to FIG. 2, when viewing the ornamental plate 2 through the crystal ball 2, the image of the ornamental plate 2 is magnified. Further, when the bulbs 14 are turned on, light of the bulbs 14 is reflected by the reflector 13 onto the ball 3 through the tiny holes 21 on the ornamental plate 2, thereby causing a lighting effect to be produced.

While only one embodiment of the present invention has been shown and described, it will be understood that various modifications and changes could be made thereunto without departing from the spirit and scope of the invention disclosed.

What the invention claimed is:

1. A crystal ball ornament comprising:

a holder base, said holder base including at least one upright wall;

a light source mounted in said at least one upright wall and controlled to emit light; and a transparent ball mounted on said holder base in front of an ornamental plate, said transparent ball holding a liquid on the inside said ornamental plate being mounted on said holder base and spaced between said light source and said transparent ball, said ornamental plate having a plurality of tiny holes through which light from said light source passes to said transparent ball.

2. The crystal ball ornament of claim 1, wherein said holder base is a sculpture.

3. The crystal ball ornament of claim 1, wherein said transparent ball has ornamental means mounted on the inside in the liquid.

4. The crystal ball ornament of claim 1, wherein said holder base includes reflector means mounted in an open chamber in said at least one upright wall for reflecting light from said light source onto said ornamental plate and said transparent ball.

5. The crystal ball ornament of claim 4, wherein said reflector means is a reflecting mirror having a plurality of facets.

6. The crystal ball ornament of claim 4, wherein said reflector means is a wrinkled aluminum foil.

* * * * *